US011382421B1

(12) United States Patent
Wolak

(10) Patent No.: US 11,382,421 B1
(45) Date of Patent: Jul. 12, 2022

(54) NOTEBOOK COMPUTER STAND

(71) Applicant: Michael J. Wolak, Brighton, MI (US)

(72) Inventor: Michael J. Wolak, Brighton, MI (US)

( * ) Notice: Subject to any disclaimer, the term of this patent is extended or adjusted under 35 U.S.C. 154(b) by 0 days.

(21) Appl. No.: 17/166,280

(22) Filed: Feb. 3, 2021

(51) Int. Cl.
*A47B 23/06* (2006.01)
*A47B 5/04* (2006.01)
*A47B 5/06* (2006.01)
*E06C 7/16* (2006.01)

(52) U.S. Cl.
CPC ..... *A47B 23/06* (2013.01); *A47B 5/04* (2013.01); *A47B 5/06* (2013.01); *E06C 7/16* (2013.01)

(58) Field of Classification Search
CPC .. A47B 23/06; A47B 5/04; A47B 5/06; E06C 7/16
USPC ..... 108/50.02
See application file for complete search history.

(56) References Cited

U.S. PATENT DOCUMENTS 530,349 A * 12/1894 Payne ..... A47B 5/04 108/135
1,679,259 A * 7/1928 Newman ..... A47B 5/04 108/135
2,716,044 A * 8/1955 Overby ..... A47B 5/04 108/166
5,170,719 A * 12/1992 Pestone ..... A47B 5/04 108/134
6,545,864 B2 4/2003 Davis, IV
7,278,644 B2 10/2007 Villarreal
7,819,387 B2 10/2010 Ou
8,127,690 B2 3/2012 Baughman
8,276,525 B2 10/2012 Janssen
8,614,886 B1 12/2013 Shammoh
D715,065 S * 10/2014 Grogan ..... D6/323
9,839,285 B2 12/2017 Cassamajor
9,995,428 B2 6/2018 Schwartz
10,285,495 B1 * 5/2019 Valme ..... A47B 23/002

FOREIGN PATENT DOCUMENTS

EP 2850967 A1 * 3/2015 ..... A47B 5/04
FR 2575910 A * 1/1985

* cited by examiner

*Primary Examiner* — Daniel J Troy
*Assistant Examiner* — Timothy M Ayres
(74) *Attorney, Agent, or Firm* — Cramer Patent & Design, PLLC; Aaron R. Cramer

(57) ABSTRACT

The laptop stand may comprise a laptop platform, a support leg, a first platform retainer, and a second platform retainer. The laptop stand may detachably couple to a work area and may be operable to support a laptop computer while the laptop computer is being used. The laptop stand may thus allow the laptop computer to be conveniently accessed in an environment where no horizontal surfaces are available upon which the laptop computer may be placed. The first platform retainer and the second platform retainer may detachably couple to the work area to support the rear of the laptop platform. The support leg may extend down from the front of the laptop platform to support the front of the laptop platform in a horizontal orientation. The laptop computer may be placed upon the laptop platform once the laptop platform is horizontally oriented.

20 Claims, 8 Drawing Sheets

NOTEBOOK COMPUTER STAND

RELATED APPLICATIONS

None.

FIELD OF THE INVENTION

The present invention relates generally to a stand and more specifically to a notebook computer stand.

BACKGROUND OF THE INVENTION

Besides being used in mobile business applications, notebook computers are becoming more frequently used in field applications by technicians and engineers involved in IT networking, security systems, fire alarm systems, access control systems, CCTV systems and the like. Many of these systems are configured, troubleshot, and repaired by simply plugging a notebook into an accessible port.

However, these field locations are typically in crowded data access closets, mechanical rooms, electrical rooms, storerooms, or the like where horizontal space to setup the notebook is at a premium. Additionally, many of these locations are accessed while on an extension or step ladder where a notebook computer cannot be safely used at all. Accordingly, there exists a need for a means by which a notebook computer can be easily and safely used under less than ideal field conditions. The development of the Notebook Computer Stand fulfills this need.

SUMMARY OF THE INVENTION

In view of the foregoing references, the inventor recognized the aforementioned inherent problems and observed that there is a need for a laptop stand which has a laptop platform having a front and a rear, a laptop computer that is placed upon the laptop platform once the laptop platform is horizontally oriented and includes a rigid plate for supporting the laptop computer, a lip which runs across the front of the laptop platform, a platform skirt, a portion which extends away from the entire bottom perimeter edge of the laptop platform, and a left restraint aperture and a right restraint aperture for coupling a left restraint and a right restraint to the laptop platform. Each of the restraints includes a restraint ring, a restraint feature, and a restraint clip.

The laptop stand also has a support leg which extends down from the front of the laptop platform to support the front of the laptop platform in a horizontal orientation. The support leg includes a leg base and a leg extension. The laptop stand also includes one or more leg retainers which are disposed beneath the front edge of the laptop platform. The one or more leg retainers are shielded by the platform skirt. The one or more leg retainers pivotably couple to a pivot rod of the support leg such that the support leg pivots under the laptop platform, which is also shielded by the platform skirt. The pivot rod is hingedly couple to the one or more leg retainers on the laptop platform such that the pivot rod pivots away from the laptop platform.

The laptop stand also has a first platform retainer and a second platform retainer detachably coupled to the work area to support the rear of the laptop platform. The first platform retainer and the second platform retainer are operable as an anchor for attachment of the left restraint and the right restraint, and the platform retainers each include a retainer clamp having a clamp body, a clamp moveable armature, and a clamp screw. The laptop stand also has a pair of flexible legs straps having a left leg strap and a right leg strap that limit the distance that the support leg pivots away from the laptop platform and a plurality of feet each having a left lateral extension lock and a right lateral extension lock.

The left restraint aperture may pass through the laptop platform from the top surface to the bottom surface at the left rear corner of the laptop platform and the right restraint aperture may pass through the laptop platform from the top surface to the bottom surface at the right rear corner of the laptop platform. The left restraint may detachably couple the left rear corner of the laptop platform to the work area and the right restraint detachably couples the right rear corner of the laptop platform to the work area. The restraint ring may couple to the laptop platform at the left restraint aperture or the right restraint aperture. A first end of the restraint feature may couple to the restraint ring, which may be coupled to a second end of the restraint feature. The restraint clip may detachably couple to the first platform retainer or the second platform retainer. The restraint clip may be clipped directly to the restraint ring, bypassing the restraint feature, if the laptop platform is adjacent to the work area and the separation provided by the restraint feature is neither necessary nor desired.

The lip may be an upward projection from the front edge of the laptop platform to prevent the laptop computer from sliding off of the front of the laptop platform. The support leg may be stored against the bottom of the laptop platform and the support leg may extend and pivot to support the front end of the laptop platform when in use. The leg base may be hingedly coupled to the bottom of the laptop platform and the leg extension may slidably couple to the leg base and may be extended away from the leg base to lengthen the support leg. The leg base may include the pivot rod, the left base strut, and the right base strut.

The leg base may include a strut cross brace which may be coupled between the left base strut and the right base strut on the lower one-half of the left base strut and the right base strut to keep the left base strut and the right base strut aligned even when the leg extension is completely removed from the leg base. The leg extension may include the left extension strut, the right extension strut, the foot, a left lateral extension armature, and a right lateral extension armature. The lower end of the left extension strut and the right extension strut may be each coupled to one of the foot. The top of the left leg strap may be coupled to the left rear underside of the laptop platform and the bottom of the left leg strap form a left self-loop that encircles a left base strut or a left extension strut.

The top of the right leg strap may be coupled to the right rear underside of the laptop platform and the bottom of the right leg strap may form a right self-loop that may encircle a right base strut or a right extension strut. The left extension strut and the right extension strut may extend laterally from within a foot of the leg extension to span an opening in the work area. The upper end of the left base strut may be coupled to the pivot rod that projects perpendicularly to the pivot rod. The lower end of the right base strut may be hollow such that the right extension strut slides into the right base strut. The left base strut may include a left strut extension lock and the right base strut may include a right strut extension lock to lock the leg extension into the leg base such that the length of the support leg does not change.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
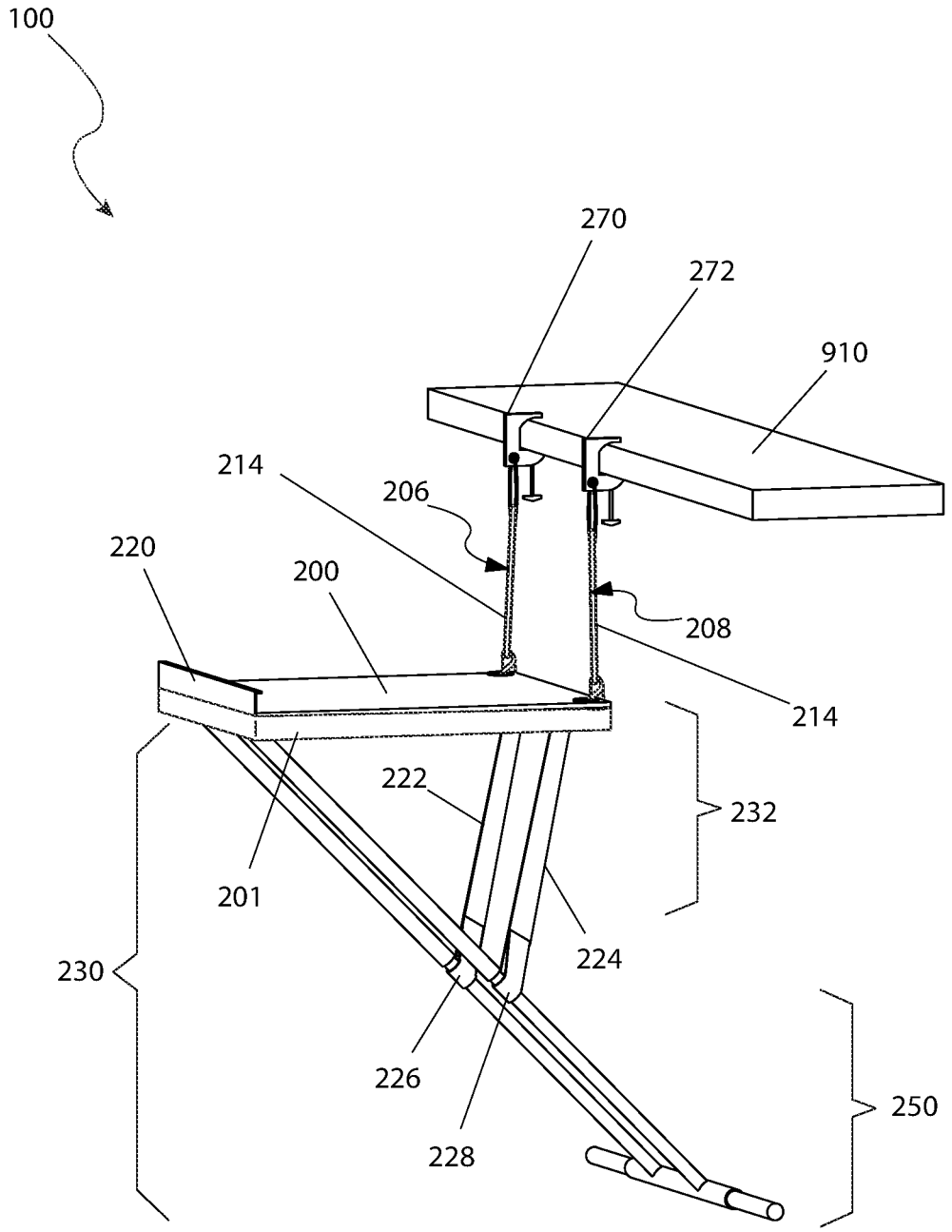
FIG. 1 is an isometric view of a laptop stand, according to an embodiment of the present invention.

100 laptop stand
200 laptop platform
201 platform skirt
202 left restraint aperture
204 right restraint aperture
206 left restraint
208 right restraint
210 individual restraint
212 restraint ring
214 restraint feature
216 restraint clip
218 leg retainer
220 lip
222 left leg strap
224 right leg strap
226 left self-loop
228 right self-loop
230 support leg
232 leg base
234 pivot rod
240 left base strut
242 left strut extension lock
244 right base strut
246 right strut extension lock
250 leg extension
252 left extension strut
254 right extension strut
260 foot
262 left lateral extension lock
264 right lateral extension lock
266 left lateral extension armature
268 right lateral extension armature
270 first platform retainer
272 second platform retainer
280 retainer clamp
282 clamp body
284 clamp moveable armature
286 clamp screw
288 retrained aperture
900 laptop computer
910 work area
916 ladder

DESCRIPTION OF THE INVENTION

Figure 8:
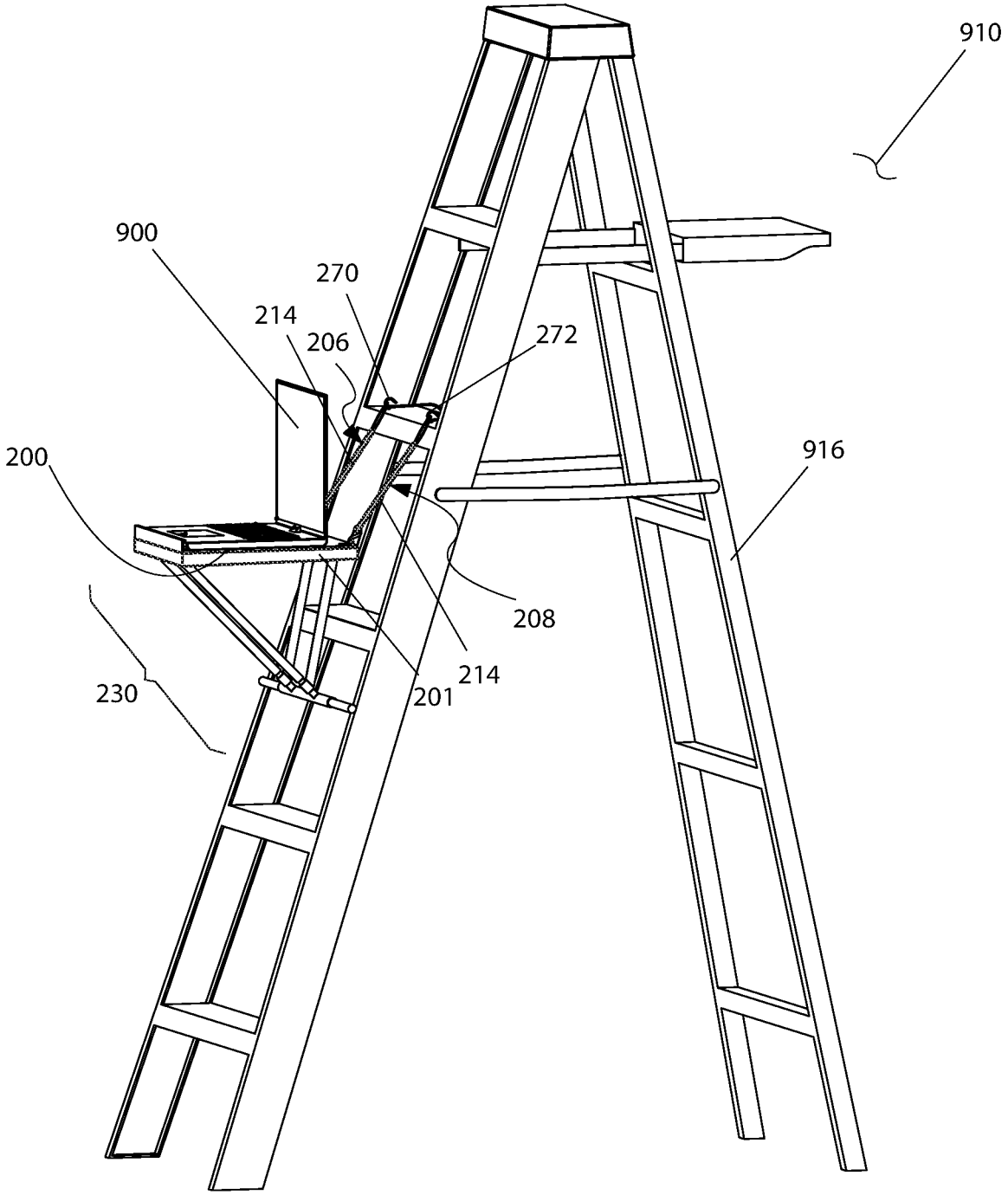
FIG. 8 is an in-use view of a laptop stand, according to an embodiment of the present invention, illustrating the laptop stand coupled to a ladder while supporting a laptop.

FIG. 1 is an isometric view of a laptop stand, according to an embodiment of the present invention. The present invention is directed to a laptop stand (herein described as the "invention") 100. The invention 100 may comprise a laptop platform 200, a support leg 230, a first platform retainer 270, and a second platform retainer 272. The invention 100 may detachably couple to a work area 910 and may be operable as a stand which may support a laptop computer 900 while the laptop computer 900 is being used. The invention 100 may thus allow the laptop computer 900 to be conveniently accessed in an environment where no horizontal surfaces are available upon which the laptop computer 900 may be placed. FIG. 8 is an in-use view of a laptop stand, according to an embodiment of the present invention, illustrating the laptop stand coupled to a ladder while supporting a laptop. As non-limiting examples, the work area 910 to which the invention 100 is coupled may be a panel enclosure, an equipment rack, or a ladder 916. The invention 100 may appeal to field service personnel working in the areas of, but not limited to, IT networking, security systems, fire alarm systems, access control systems, CCTV systems, and data centers. The first platform retainer 270 and the second platform retainer 272 may detachably couple to the work area 910 to support the rear of the laptop platform 200. The support leg 230 may extend down from the front of the laptop platform 200 to support the front of the laptop platform 200 in a horizontal orientation. The laptop computer 900 may be placed upon the laptop platform 200 once the laptop platform 200 is horizontally oriented.

The laptop platform 200 may be a rigid plate for supporting the laptop computer 900. The laptop platform 200 may be oriented horizontally during use. In a preferred embodiment, the laptop platform 200 may measure fifteen inches with two-inch error (15±2 in.) from side to side and eleven inches with a one-inch error (11±1 in.) from front to rear.

The laptop platform 200 may comprise a lip 220 running across the front of the laptop platform 200. The lip 220 may be an upward projection from the front edge of the laptop platform 200 that is operable to prevent the laptop computer 900 from sliding off of the front of the laptop platform 200. The horizontal orientation of the laptop platform 200 is not critical because the lip 220 may prevent the laptop computer 900 from sliding forward. In some embodiments, the rear of the laptop platform 200 may be elevated such that the laptop platform 200 is angled up to thirty-five degrees (35°) from horizontal. The laptop platform 200 also may comprise a platform skirt 201, a portion that extends away from the entire bottom perimeter edge of the laptop platform 200. The platform skirt 201 is the same thickness as the laptop platform 200 and may be formed from the same material. The platform skirt 201 depends downward from the laptop platform 200 approximately one inch (1 in.) in height, or any such height that provides protective shielding for the moving portions of the attachment of the support leg 230 to the under surface of the laptop platform 200.

Figure 6:
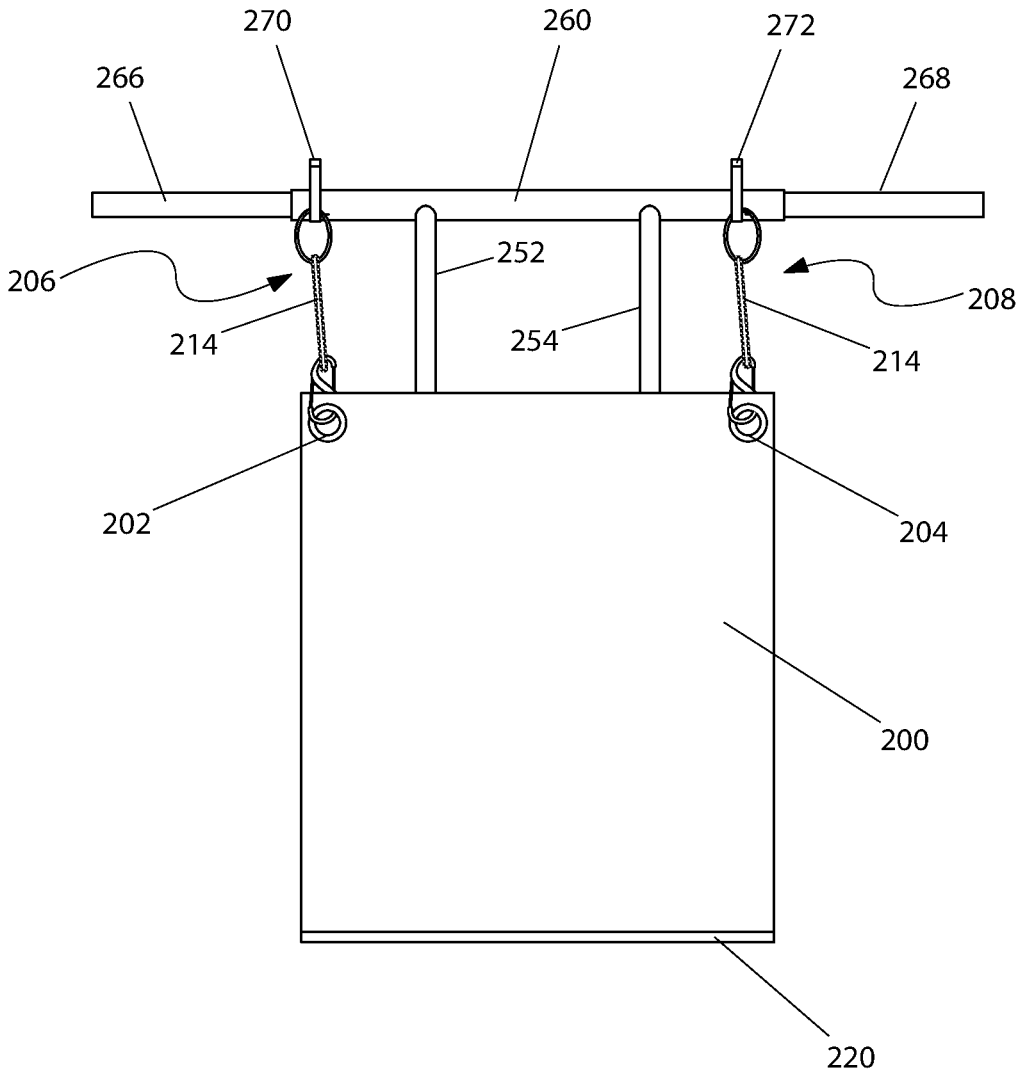
FIG. 6 is a top view of a laptop stand, according to an embodiment of the present invention.

FIG. 6 is a top view of a laptop stand, according to an embodiment of the present invention. The laptop platform 200 may comprise a left restraint aperture 202 and a right restraint aperture 204 for coupling a left restraint 206 and a right restraint 208 to the laptop platform 200. The left restraint aperture 202 may pass through the laptop platform 200 from the top surface to the bottom surface at the left rear corner of the laptop platform 200. The right restraint aperture 204 may pass through the laptop platform 200 from the top surface to the bottom surface at the right rear corner of the laptop platform 200.

The left restraint 206 may detachably couple the left rear corner of the laptop platform 200 to the work area 910. The right restraint 208 may detachably couple the right rear corner of the laptop platform 200 to the work area 910. An individual restraint 210 selected from the left restraint 206 and the right restraint 208 may comprise a restraint ring 212, a restraint feature 214, and a restraint clip 216. The restraint ring 212 may couple to the laptop platform 200 at the left restraint aperture 202 or the right restraint aperture 204. A first end of the restraint feature 214 may couple to the restraint ring 212. The restraint clip 216 may couple to a second end of the restraint feature 214. The restraint clip 216 may detachably couple to the first platform retainer 270 or the second platform retainer 272. The restraint feature 214 may provide horizontal or vertical separation distance between the laptop platform 200 and the first platform retainer 270 or the second platform retainer 272. The restraint clip 216 may be clipped directly to the restraint ring 212, bypassing the restraint feature 214, if the laptop platform 200 is to be adjacent to the work area 910 and the separation provided by the restraint feature 214 is neither necessary nor desired. In a preferred embodiment, the restraint feature 214 is wire rope; other embodiments may provide for a chain or other similar resilient material.

One (1) or more leg retainers 218 may be located beneath the front edge of the laptop platform 200, preferably shielded by the platform skirt 201. Each leg retainer 218 may pivotably couple to a pivot rod 234 of the support leg 230 such that the support leg 230 may pivot under the laptop platform 200, also shielded by the platform skirt 201. In some embodiments, the one (1) or more leg retainers 218 may constrain the pivot rod 234 from sliding laterally.

Figure 2:
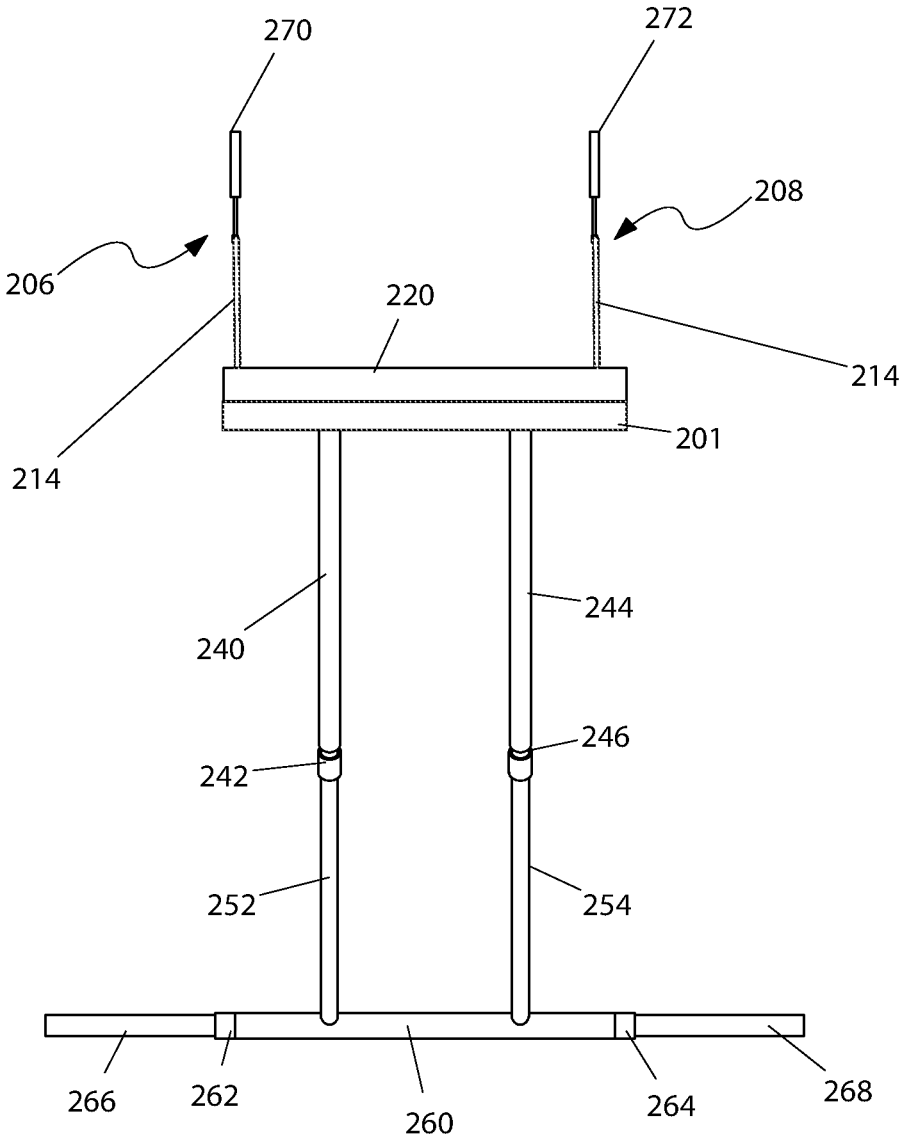
FIG. 2 is a front view of a laptop stand, according to an embodiment of the present invention.
Figure 3:
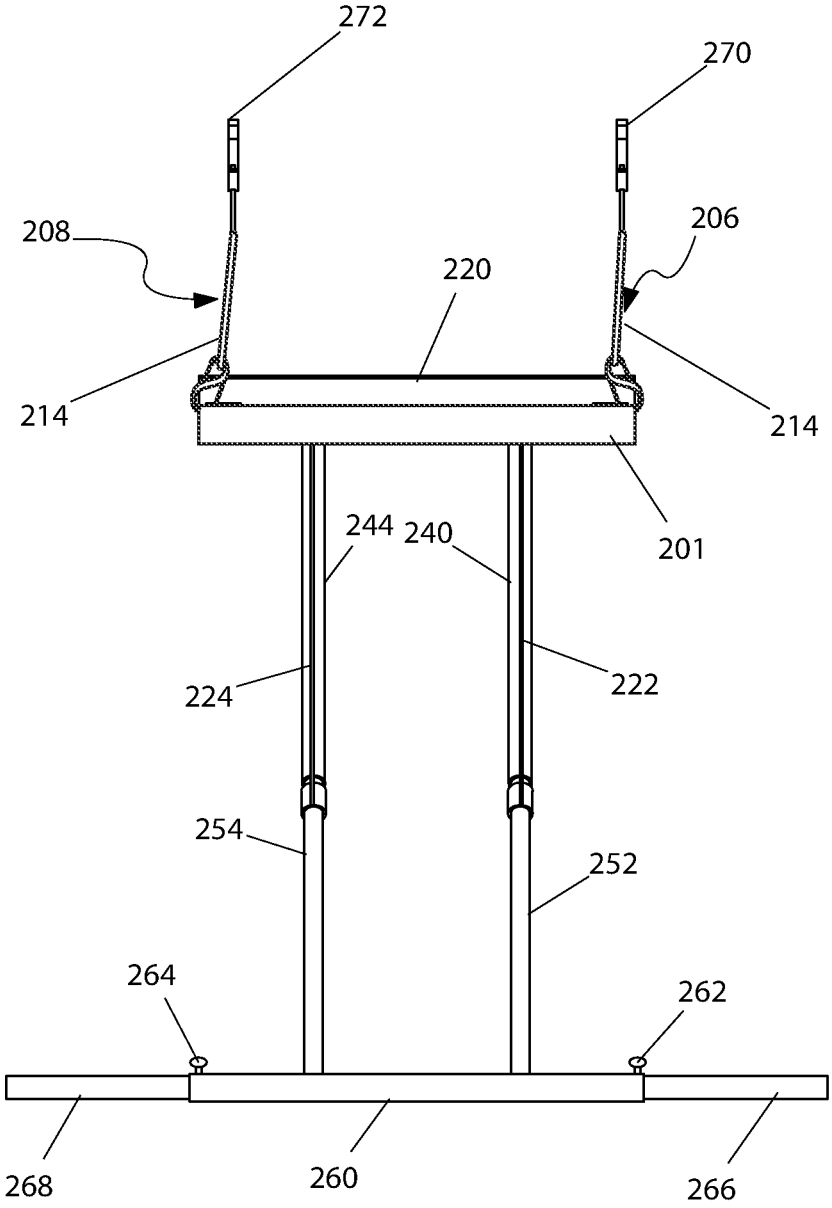
FIG. 3 is a rear view of a laptop stand, according to an embodiment of the present invention.

FIG. 2 is a front view of a laptop stand, according to an embodiment of the present invention. FIG. 3 is a rear view of a laptop stand, according to an embodiment of the present invention. A left leg strap 222 and a right leg strap 224 may be flexible straps that limit the distance that the support leg 230 may pivot away from the laptop platform 200. The top of the left leg strap 222 may be coupled to the left rear underside of the laptop platform 200. The bottom of the left leg strap 222 may form a left self-loop 226 that encircles a left base strut 240 or a left extension strut 252. The left self-loop 226 may slide up and down between the left base strut 240 and the left extension strut 252. The top of the right leg strap 224 may be coupled to the right rear underside of the laptop platform 200. The bottom of the right leg strap 224 may form a right self-loop 228 that encircles a right base strut 244 or a right extension strut 254. The right self-loop 228 may slide up and down between the right base strut 244 and the right extension strut 254. Other embodiments provide for the left leg strap 22 and right leg strap 224 to be length adjustable.

The support leg 230 may comprise a leg base 232 and a leg extension 250. The support leg 230 may be stored against the bottom of the laptop platform 200. The support leg 230 may extend and pivot to support the front end of the laptop platform 200 when in use. The leg base 232 may be hingedly coupled to the bottom of the laptop platform 200. The leg extension 250 may slidably couple to the leg base 232 and may be extended away from the leg base 232 to lengthen the support leg 230. The left extension strut 252 and the right extension strut 254 may extend laterally from within a foot 260 of the leg extension 250 to span an opening in the work area 910.

Figure 7:
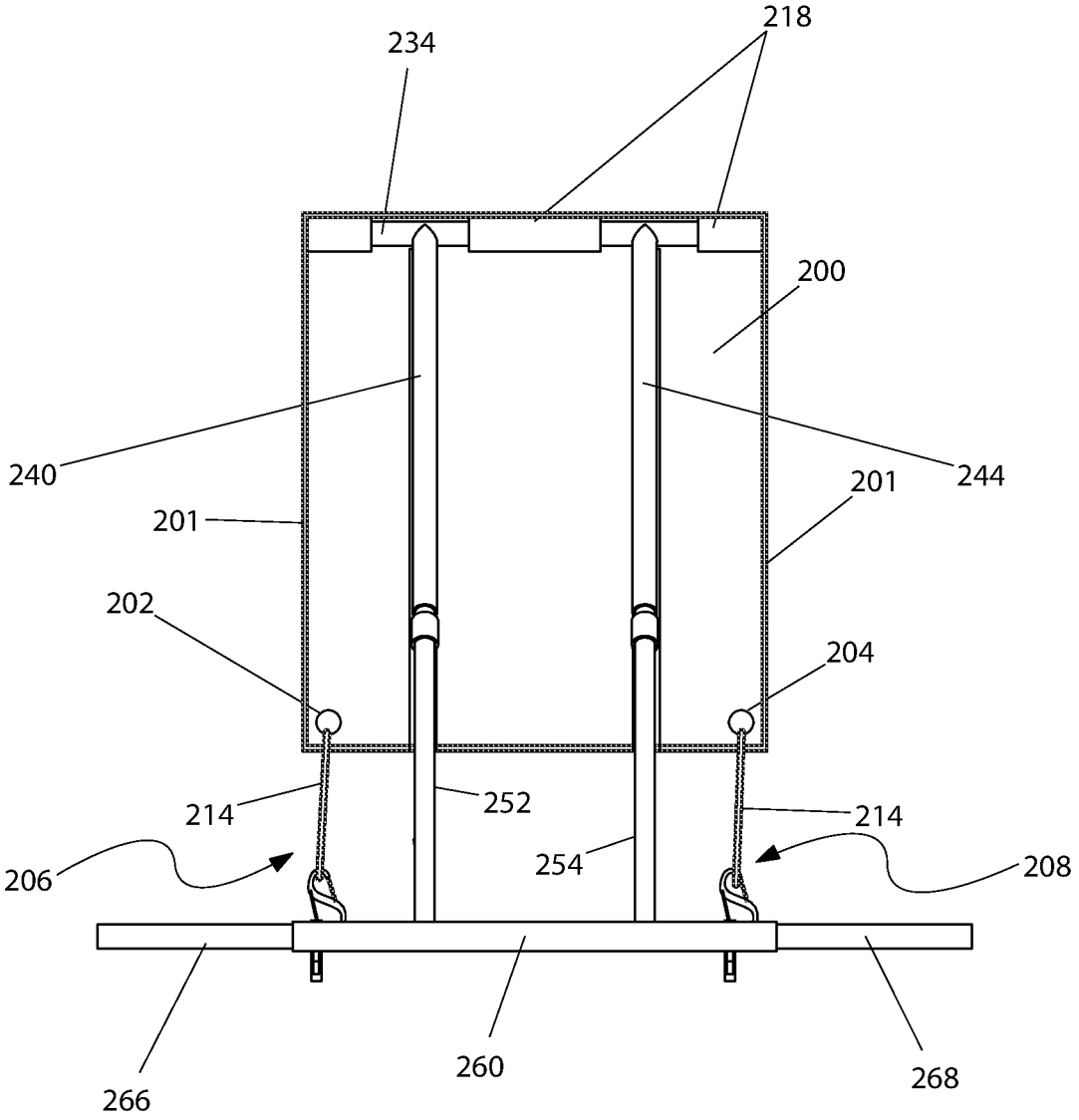
FIG. 7 is a bottom view of a laptop stand, according to an embodiment of the present invention.

FIG. 7 is a bottom view of a laptop stand, according to an embodiment of the present invention. The leg base 232 may comprise the pivot rod 234, the left base strut 240, and the right base strut 244. The pivot rod 234 may hingedly couple to the one (1) or more leg retainers 218 on the laptop platform 200 such that the pivot rod 234 may pivot away from the laptop platform 200. The upper end of the left base strut 240 may couple to the pivot rod 234 and may project perpendicularly to the pivot rod 234. The lower end of the left base strut 240 may be hollow such that the left extension strut 252 may slide into the left base strut 240. The upper end of the right base strut 244 may couple to the pivot rod 234 and may project perpendicularly to the pivot rod 234. The lower end of the right base strut 244 may be hollow such that the right extension strut 254 may slide into the right base strut 244. The right base strut 244 may be oriented to be parallel to the left base strut 240.

In some embodiments, the leg base 232 may further comprise a strut cross brace coupled between the left base strut 240 and the right base strut 244 on the lower one-half (½) of the left base strut 240 and the right base strut 244. The strut cross brace may be operable to keep the left base strut 240 and the right base strut 244 aligned even when the leg extension 250 is completely removed from the leg base 232. The strut cross brace may be oriented to be parallel to the pivot rod 234.

The left base strut 240 may comprise a left strut extension lock 242 and the right base strut 244 may comprise a right strut extension lock 246. The left strut extension lock 242 and the right strut extension lock 246 may be operable to lock the leg extension 250 into the leg base 232 such that the length of the support leg 230 may not change. As non-limiting examples, the left strut extension lock 242 and the right strut extension lock 246 may be thumbscrews that pass through the left base strut 240 and the right base strut 244 and press against the left extension strut 252 and the right extension strut 254 or the left strut extension lock 242 and the right strut extension lock 246 may be telescopic tube clamps.

The leg extension 250 may comprise the left extension strut 252, the right extension strut 254, the foot 260, a left lateral extension armature 266, and a right lateral extension armature 268. The lower end of the left extension strut 252 may couple to the foot 260. The outside diameter of the left extension strut 252 may be less than the inside diameter of the left base strut 240 such that the upper end of the left extension strut 252 may slide into the left base strut 240. The lower end of the right extension strut 254 may couple to the foot 260. The outside diameter of the right extension strut 254 may be less than the inside diameter of the right base strut 244 such that the upper end of the right extension strut 254 may slide into the right base strut 244. The right extension strut 254 may be oriented to be parallel to the left extension strut 252.

The support leg 230 may be lengthened by releasing the left strut extension lock 242 and the right strut extension lock 246 and by sliding the left extension strut 252 and the right extension strut 254 out of the left base strut 240 and the right base strut 244 such that the foot 260 moves farther away from the laptop platform 200. The length of the support leg 230 may be fixed by securing the left strut extension lock 242 and the right strut extension lock 246. The support leg 230 may be shortened by releasing the left strut extension lock 242 and the right strut extension lock 246 and by sliding the left extension strut 252 and the right extension strut 254 into the left base strut 240 and the right base strut 244 such that the foot 260 moves towards the laptop platform 200.

The foot 260 may be hollow such that the left lateral extension armature 266 and the right lateral extension armature 268 may slide into the foot 260. The outside diameter of the left lateral extension armature 266 may be less than the inside diameter of the foot 260 such that the proximal end of the left lateral extension armature 266 may slide into the left end the foot 260. The outside diameter of the right lateral extension armature 268 may be less than the inside diameter of the foot 260 such that the proximal end of the right lateral extension armature 268 may slide into the right end of the foot 260. The width of the foot 260 may be increased by extending the left lateral extension armature 266 and the right lateral extension armature 268.

The foot 260 may comprise a left lateral extension lock 262 and a right lateral extension lock 264. The left lateral extension lock 262 may be operable to lock the left lateral extension armature 266 into the foot 260 such that the width of the foot 260 may not be increased on the left side. The right lateral extension lock 264 may be operable to lock the right lateral extension armature 268 into the foot 260 such that the width of the foot 260 may not be increased on the right side. As non-limiting examples, the left lateral extension lock 262 and the right lateral extension lock 264 may be thumbscrews that pass through the foot 260 and press against the left lateral extension armature 266 and the right lateral extension armature 268 or the left lateral extension lock 262 and the right lateral extension lock 264 may be telescopic tube clamps.

The first platform retainer 270 and the second platform retainer 272 may detachably couple to the work area 910. The first platform retainer 270 and the second platform retainer 272 may be operable as anchors for attachment of the left restraint 206 and the right restraint 208.

Figure 4:
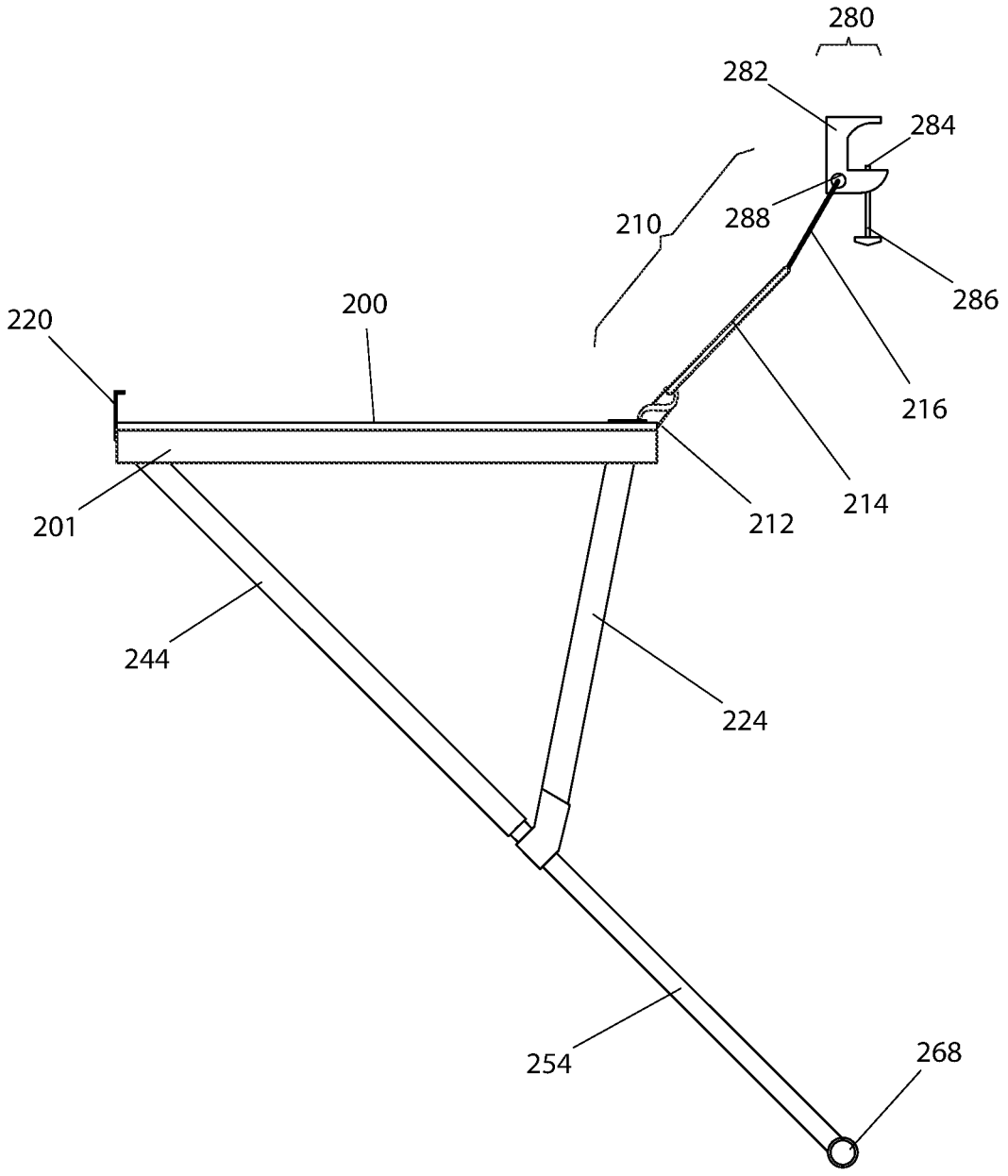
FIG. 4 is a right side view of a laptop stand, according to an embodiment of the present invention.

FIG. 4 is a right side view of a laptop stand, according to an embodiment of the present invention. An individual platform retainer selected from the first platform retainer 270 and the second platform retainer 272 may be a retainer clamp 280. The retainer clamp 280 may comprise a clamp body 282, a clamp moveable armature 284, and a clamp screw 286. The retainer clamp 280 may be detachably coupled to the work area 910 by grasping a portion of the work area 910 between the clamp body 282 and the clamp moveable armature 284. The clamp screw 286 may be operable to move the clamp moveable armature 284 towards or away from the clamp body 282 such that the retainer clamp 280 may be tightened against the work area 910 or loosened for removal from the work area 910. The clamp body 282 may comprise a retrained aperture 288 for coupling the left restraint 206 or the right restraint 208 to the retainer clamp 280.

Figure 5:
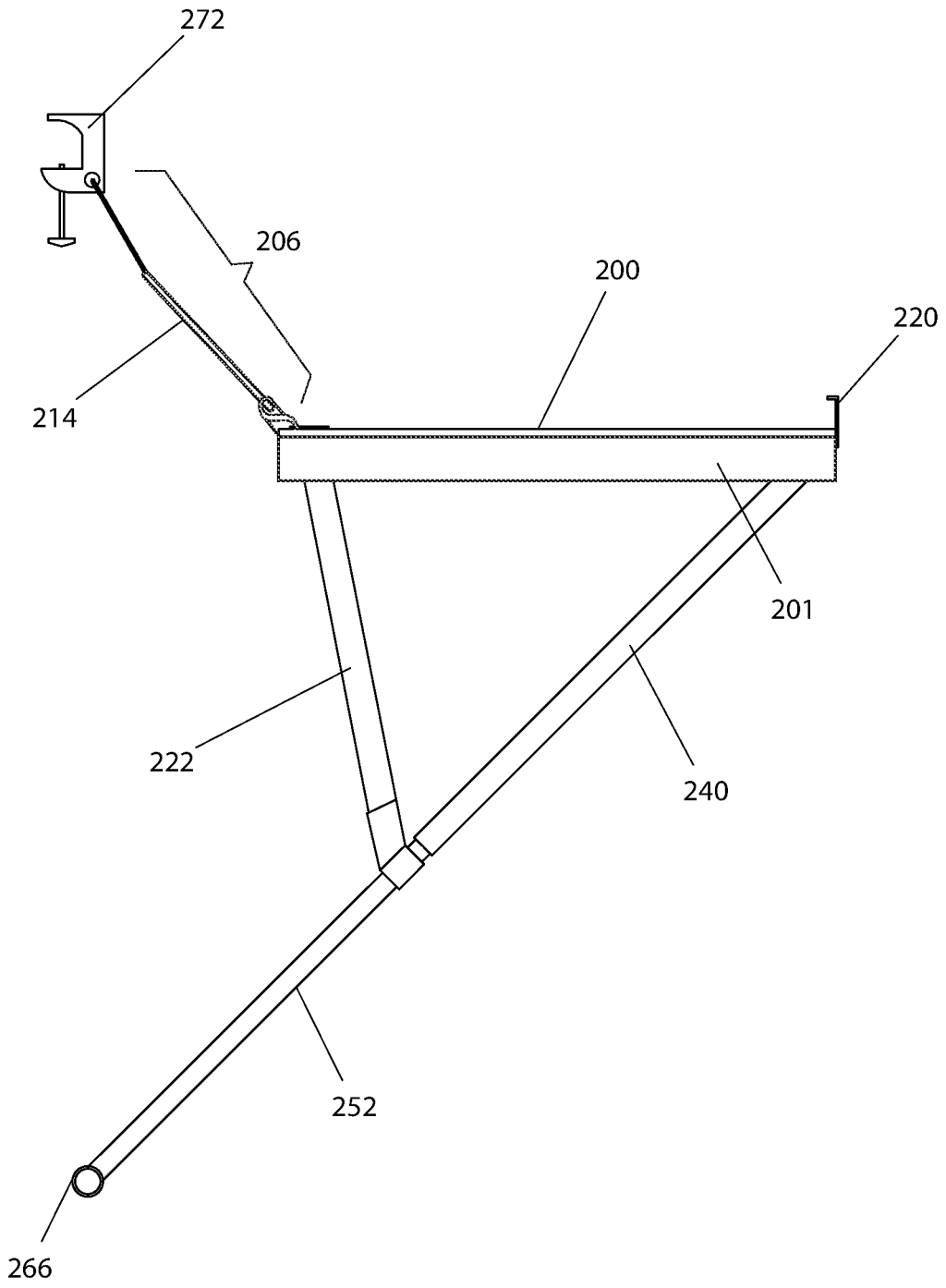
FIG. 5 is a left side view of a laptop stand, according to an embodiment of the present invention.

FIG. 5 is a left side view of a laptop stand, according to an embodiment of the present invention. The left restraint 206 and the right restraint 208 may be coupled to other forms of anchors. As a non-limiting example, wire hooks may be detachably coupled to the work area 910 and the left restraint 206 and the right restraint 208 may be coupled to the wire hooks.

In some embodiments, the support leg 230, the first platform retainer 270, the second platform retainer 272, or combinations thereof may be stored under the laptop platform 200. In such embodiments, the support leg 230, the first platform retainer 270, and/or the second platform retainer 272 may be retained beneath the laptop platform 200 by a clip, magnet, or other retention mechanism that is positioned and shaped to retain the corresponding the support leg 230, the first platform retainer 270, and/or the second platform retainer 272.

In use, a user may enter the work area 910 and find it necessary to use the laptop computer 900. The user may couple the first platform retainer 270 and the second platform retainer 272 to the work area 910. As non-limiting examples, the first platform retainer 270 and the second platform retainer 272 may be coupled to a shelf, equipment frame, or rung of a ladder. The user may pivot the support leg 230 away from the laptop platform 200. The user may couple the left restraint 206 to the first platform retainer 270 and the right restraint 208 to the second platform retainer 272 to secure the rear of the laptop platform 200 to the work area 910. The user may extend the leg extension 250 and position the support leg 230 such that the laptop platform 200 is held in a horizontal orientation by the left restraint 206, the right restraint 208, and the support leg 230. If the support leg 230 is aligned with an opening in the work area 910 that is wider than the foot 260, the left lateral extension armature 266 and the right lateral extension armature 268 may be extended to span the opening. The left strut extension lock 242, the right strut extension lock 246, the left lateral extension lock 262, and the right lateral extension lock 264 may be operable to assure that the support leg 230 does not change length, orientation, or width while in used.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A laptop stand, comprising:

a laptop platform having a front and a rear, is configured that a laptop computer is placed upon the laptop platform once the laptop platform is horizontally oriented and includes a rigid plate for supporting the laptop computer, a lip running across the front of the laptop platform, a platform skirt, a portion that extends away from the entire bottom perimeter edge of the laptop platform, and a left restraint aperture and a right restraint aperture for coupling a left restraint and a right restraint to the laptop platform, each of the restraints includes a restraint ring, a restraint feature, and a restraint clip;

a support leg extend down from the front of the laptop platform to support the front of the laptop platform in a horizontal orientation, the support leg includes a leg base and a leg extension;

one or more leg retainers disposed beneath the front edge of the laptop platform, the one or more leg retainers are shielded by the platform skirt, the one or more leg retainers pivotably couples to a pivot rod of the support leg such that the support leg pivots under the laptop platform, which is also shielded by the platform skirt, and the pivot rod is hingedly couple to the one or more leg retainers on the laptop platform such that the pivot rod pivots away from the laptop platform;

a first platform retainer and a second platform retainer detachably coupled to the work area to support the rear of the laptop platform, the first platform retainer and the second platform retainer are operable as an anchor for attachment of the left restraint and the right restraint, and the platform retainers each include a retainer clamp having a clamp body, a clamp moveable armature, and a clamp screw;

a pair of flexible legs straps having a left leg strap and a right leg strap that limit the distance that the support leg pivots away from the laptop platform; and a plurality of feet each having a left lateral extension lock and a right lateral extension lock.

2. The laptop stand, according to claim 1, wherein the left restraint aperture passes through the laptop platform from the top surface to the bottom surface at the left rear corner of the laptop platform and the right restraint aperture passes through the laptop platform from the top surface to the bottom surface at the right rear corner of the laptop platform.

3. The laptop stand, according to claim 1, wherein the left restraint detachably couples the left rear corner of the laptop platform to the work area and the right restraint detachably couples the right rear corner of the laptop platform to the work area.

4. The laptop stand, according to claim 1, wherein the restraint ring couples to the laptop platform at the left restraint aperture or the right restraint aperture.

5. The laptop stand, according to claim 1, wherein a first end of the restraint feature couples to the restraint ring, which is coupled to a second end of the restraint feature.

6. The laptop stand, according to claim 1, wherein the restraint clip detachably couples to the first platform retainer or the second platform retainer.

7. The laptop stand, according to claim 1, wherein the restraint clip is clipped directly to the restraint ring, bypassing the restraint feature, if the laptop platform is adjacent to the work area and the separation provided by the restraint feature is neither necessary nor desired.

8. The laptop stand, according to claim 1, wherein the lip is an upward projection from the front edge of the laptop platform to prevent the laptop computer from sliding off of the front of the laptop platform.

9. The laptop stand, according to claim 1, wherein the support leg is stored against the bottom of the laptop platform and the support leg extends and pivots to support the front end of the laptop platform when in use.

10. The laptop stand, according to claim 1, wherein the leg base is hingedly coupled to the bottom of the laptop platform and the leg extension is slidably couple to the leg base and is extended away from the leg base to lengthen the support leg.

11. The laptop stand, according to claim 1, wherein the leg base includes the pivot rod, the left base strut, and the right base strut.

12. The laptop stand, according to claim 1, wherein the leg base includes a strut cross brace coupled between the left base strut and the right base strut on the lower one-half of the left base strut and the right base strut to keep the left base strut and the right base strut aligned even when the leg extension is completely removed from the leg base.

13. The laptop stand, according to claim 1, wherein the leg extension includes the left extension strut, the right extension strut, the foot, a left lateral extension armature, and a right lateral extension armature.

14. The laptop stand, according to claim 1, wherein the lower end of the left extension strut and the right extension strut are each coupled to one of the foot.

15. The laptop stand, according to claim 1, wherein the top of the left leg strap is coupled to the left rear underside of the laptop platform and the bottom of the left leg strap form a left self-loop that encircles a left base strut or a left extension strut.

16. The laptop stand, according to claim 1, wherein the top of the right leg strap is coupled to the right rear underside of the laptop platform and the bottom of the right leg strap forms a right self-loop that encircles a right base strut or a right extension strut.

17. The laptop stand, according to claim 1, wherein the left extension strut and the right extension strut extends laterally from within a foot of the leg extension to span an opening in the work area.

18. The laptop stand, according to claim 1, wherein the upper end of the left base strut coupled to the pivot rod that projects perpendicularly to the pivot rod.

19. The laptop stand, according to claim 1, wherein the lower end of the right base strut is hollow such that the right extension strut slides into the right base strut.

20. The laptop stand, according to claim 1, wherein the left base strut includes a left strut extension lock and the right base strut includes a right strut extension lock to lock the leg extension into the leg base such that the length of the support leg does not change.

* * * * *